US008409322B2

(12) United States Patent
Zakosek et al.

(10) Patent No.: US 8,409,322 B2
(45) Date of Patent: Apr. 2, 2013

(54) METHOD FOR AGGLOMERATING INDUSTRIAL DUST, IN PARTICULAR USING A BRIQUETTING TECHNIQUE

(75) Inventors: Gilles Zakosek, Saint Etienne (FR); Alain Senetaire, Seyssuel (FR)

(73) Assignee: S.P.C.M. SA, Andrezieux-Boutheon (FR)

( * ) Notice: Subject to any disclaimer, the term of this patent is extended or adjusted under 35 U.S.C. 154(b) by 69 days.

(21) Appl. No.: 13/122,197

(22) PCT Filed: Nov. 2, 2009

(86) PCT No.: PCT/FR2009/052111

§ 371 (c)(1), (2), (4) Date: Apr. 1, 2011

(87) PCT Pub. No.: WO2010/058111

PCT Pub. Date: May 27, 2010

(65) Prior Publication Data

US 2011/0209582 A1 Sep. 1, 2011

(30) Foreign Application Priority Data

Nov. 21, 2008 (FR) ..... 08 57906

(51) Int. Cl.
*C22B 1/16* (2006.01)

(52) U.S. Cl. ..... 75/772; 75/773

(58) Field of Classification Search ..... 75/772, 75/773

See application file for complete search history.

(56) References Cited

U.S. PATENT DOCUMENTS

| | | | | |
|---|---|---|---|---|
| 3,893,847 | A | 7/1975 | Derrick | |
| 4,802,914 | A | 2/1989 | Rosen et al. | |
| 5,443,788 | A * | 8/1995 | Palowitz et al. | 419/65 |
| 6,293,994 | B1 * | 9/2001 | Field et al. | 75/772 |
| 6,384,126 | B1 | 5/2002 | Pirtle et al. | |
| 2007/0119563 | A1 * | 5/2007 | Schmitt et al. | 164/528 |

FOREIGN PATENT DOCUMENTS

WO 96/39290 A 12/1996

OTHER PUBLICATIONS

International Search Report for PCT/FR2009/052111 dated Mar. 3, 2010.

* cited by examiner

*Primary Examiner* — George Wyszomierski
*Assistant Examiner* — Tima McGuthry-Banks
(74) *Attorney, Agent, or Firm* — Heslin Rothenberg Farley & Mesiti P.C.

(57) ABSTRACT

Process for agglomerating industrial dusts comprises: kneading in a vat the dusts to be agglomerated in the presence of a first binder comprising a polymer with a molecular weight above 500,000 g/mol, which is in the form of a reverse emulsion; then adding to the vat separately, while still kneading, a second binder comprising a silicate of an alkaline metal; and finally compacting the resulting agglomerates under pressure.

16 Claims, No Drawings

METHOD FOR AGGLOMERATING INDUSTRIAL DUST, IN PARTICULAR USING A BRIQUETTING TECHNIQUE

CROSS REFERENCE TO RELATED APPLICATIONS

This application is a national stage filing under section 371 of International Application No. PCT/FR2009/052111 filed on Nov. 2, 2009, and published in French on May 27, 2010 as WO 2010/058111 and claims priority of French application No. 0857906 filed on Nov. 21, 2008, the entire disclosure of these applications being hereby incorporated herein by reference.

BACKGROUND ART

The invention concerns a process for agglomerating industrial dusts, in particular using a briquetting technique.

In the present invention by industrial dusts is meant: dust and/or fines of foundries, steel mills and blast furnaces rich in metal oxides, stemming particularly from dedusting systems, as well as dusts or fines of gas-cutting residues and other cutting work and of sludge formed by the process and/or lagooning.

Since an industrial dust cannot be manipulated as it is because it is too volatile, it must be agglomerated to enable it to be transported and used.

Agglomerization is a process based on the adhesion of particles to one another to obtain agglomerates of a larger size.

There exist agglomeration processes not involving pressure, namely of the pelletization type, and processes using pressure, such as briquetting. The invention concerns the second of these two technologies.

U.S. Pat. No. 4,802,914 A describes an agglomeration process which uses pelletization (wet agglomeration) and consists of agglomerating dust within a rotary drum while continuously adding, in the presence of water, a mixture of dust and binder. Binders are polymers of high molecular weight which are added before, during or after the use of alkaline inorganic salts of the phosphate, chloride or carbonate type. This patent also refers to the use of bentonite as the binder which is an aluminum phyllosilicate, a complex mixture of clay, montmorillonite etc., which does not fall into the category of alkaline metal silicates.

Among the pressure-agglomeration processes used on an industrial scale, the most developed one is the <<briquetting>> one. The main advantages of this compacting technique are its high capacity (in terms of treated volumes) and its flexibility of use (agglomerates of multiple dimensions and shapes).

The briquetting is performed on tangent roll presses provided with cavities that impress the desired shape onto the agglomerates also known as briquettes. It can be carried out hot or cold, at highly variable pressures and with or without the aid of a binder.

A binder is a material of high viscosity or hydraulics (for example cement) applied to impregnate the dust so as to ensure the cohesion of the dust in the form of briquettes and to impart to the grains sufficient mechanical resistance to be able to resist vibration and movements to which they are subjected in the course of various manipulations.

Among the currently used organic binders, we mention starch, cellulose, molasses etc. The use of these binders, however, can present problems due to the presence of impurities harmful to the industrial process (for example, sulfur in siderurgy) and/or because they give rise to agglomerates with unsatisfactory mechanical properties.

It thus seemed that the use and valorization of metal oxides contained in agglomerates obtained by prior-art techniques were not optimal.

Document WO96/39290 describes a multistep agglomeration process by briquetting that consists of mixing the dusts with a source of carbon (coke) the purpose of which is to provide heat transfer at the time of the fusion, and also with a mixture of polymer and inorganic salts (calcium carbonate and an aluminosilicate) and then, before the last compression step, of adding an emulsion of a polyvinyl polymer to the product obtained.

The present invention has for an object to avoid these drawbacks.

BRIEF SUMMARY OF INVENTION

It concerns a process for agglomerating industrial dusts which consists of:

- kneading in a vat the dusts to be agglomerated in the presence of a first binder comprising a polymer with a molecular weight above 500,000 g/mol, which is in the form of a reverse emulsion,
- then adding to the vat separately, while still kneading, a second binder comprising a silicate of an alkaline metal, and
- finally compacting the resulting agglomerates under pressure.

The process of the invention is carried out without adding exogenous water, namely without adding water other than that introduced with the active materials. This, for example, is the case with silicates which are formulated in aqueous form.

According to the process, the dusts can be treated with lime or not.

In practice, the mixing time of the dusts with the first binder is between 30 seconds and 5 minutes.

Similarly, the time of kneading of the mixture obtained in the first step with the second binder is between 1 min and 10 minutes.

DETAILED DESCRIPTION

The invention will be better understood after reading the following.

The main object of the invention is to provide briquettes that have surprisingly improved properties compared to the aggregates of the prior art.

The briquetting process of the invention is based on the agglomeration of industrial dusts in the presence of a combination of two specific binders.

It has been unexpectedly found that this association of binders offers very high cohesion and adhesion characteristics during the passage through the compactor. The use of these binders makes it possible, among other things, to achieve rapid solidification in a few minutes and to obtain briquettes or balls with good abrasion resistance and with a cohesion that allows them to be manipulated and transported.

Moreover, the invention makes it possible, during recycling of these agglomerates, that no substances harmful to the industrial process, such as sulfur, be introduced with the briquettes thus obtained.

According to the invention, it is essential that the polymer be added prior to the silicate.

The mixture is produced in an appropriate solid mixer or blender for which a person skilled in the art will, from his own knowledge, be able to determine the conditions needed for the mixture to be as homogeneous as possible.

The mixture thus obtained is then sent to a press to confer to it a defined shape. The briquettes (also known as balls) are obtained by compression molding. They can be of different dimensions. Once obtained, they are transferred to a storage zone.

Another object of the invention consists of using the afore-defined agglomerates to recycle the dusts and/or fines from foundries, steel mills and blast furnaces, rich in metal oxides, as complementary loads to fusion equipment. This results in an enrichment of the fusion bath which is proportional to the quantity of briquettes that are added to complement the load and permits the valorization thereof. To do this, according to a variant of the invention, the briquettes can contain a certain amount of a reducing agent to permit the conversion of the metal oxides into metals so that it will not be necessary to again add the metals to the fusion bath.

DEFINITION AND DOSAGES OF THE BINDERS a/ The High-Molecular-Weight Polymer:

This is a water-soluble organic polymer with an ionicity comprised between 10 and 90 mole % and derived from:

- at least one ionic, cationic, zwitterionic and/or, preferably, anionic monomer,
- at least one nonionic monomer,
- and possibly from 0.02 to 2 mole % of hydrophobic monomer(s).

This polymer can also be branched in a known manner. As is known, a branched polymer is a polymer which on the main chain presents branches, groupings or ramifications, all disposed in one plane. The branching is preferably achieved during (or possibly after) the polymerization in the presence of a branching/cross-linking agent and possibly a transfer agent. Following is a non-limiting list of branching agents: methylene bisacrylamide (MBA), ethylene glycol diacrylate, polyethylene glycol dimethacrylate, diacrylamide, cyanomethyl acrylate, vinyloxyethylacrylate or methacrylate, triallylamine, formalde-hyde, glyoxal, compounds of the glycidyl ether type such as ethylene glycol diglycidyl ether, or epoxy compounds or other cross-linking means well known to those skilled in the art.

In practice, the polymer used is derived from:

a/ at least one ionic monomer selected from among:

- anionic monomers with a carboxylic function (for example: acrylic acid, methacrylic acid and their salts . . . ) or having a sulfonic acid function (for example, 2-acrylamido-2-methylpropanesulfonic acid (ATBS) and their salts . . . ),
- and/or possibly one or more cationic monomers: we mention in particular and in a non-limiting manner, dimethylaminoethyl acrylate (ADAME) (and/or dimethylaminoethyl methacrylate (MADAME) quaternized or in salt form, dimethyldiallyl-ammonium chloride (DADMAC), acrylamidopropyltrimethylammonium chloride (APTAC) and/or methacrylamidopropyltrimethylammonium chloride (MAPTAC).

b/ and at least one nonionic monomer selected from among: acrylamide, methacrylamide, N-vinylpyrrolidone, vinyl acetate, vinyl alcohol, the acrylate esters, allyl alcohol, N-vinylacetamide and/or N-vinylformamide, and is possibly used in association with a hydrophobic monomer preferably selected from the group containing—the esters of (meth) acrylic acid with an alkyl, arylalkyl and/or ethoxylated chain,—the derivatives of (meth)acrylamide with an alkyl, arylalkyl or dialkyl chain,—the cationic allylic derivatives,—the hydrophobic anionic or cationic (meth)acryloyl derivatives,—or the anionic and/or cationic (meth)acrylamide derivatives with a hydrophobic chain.

The high-molecular-weight polymer of the invention is characterized in that, during its use:

- it is in the form of a reverse emulsion, namely water in oil,
- it has a molecular weight above 500,000 g/mol and up to 20,000,000 g/mol,
- and the (dry polymer/oil) weight ratio of the emulsion is comprised between 0.15 and 1, preferably between 0.3 and 0.8, and advantageously is of the order of 0.5. This weight ratio can be obtained either directly during the polymerization of the polymer in emulsion or by adding an oil to the emulsion as polymerized and just before it is used. Preferably, if the weight ratio is obtained by addition of an oil, said oil will have to be compatible with that of the emulsion and not cause destabilization.

According to the invention, the concentration of the polymer at which it is injected into the mixer is comprised between 5 and 20% by weight.

Preferably the high-molecular-weight polymer is an anionic copolymer based on acrylamide and salts of acrylic acid, presenting an anionicity between 10 et 50 mole % and a molecular weight above 5,000,000 g/mol.

By the expression <<is in the form of a reverse emulsion>>, referring to the polymer used according to the invention, those skilled in the art will understand that in this manner is designated the reverse emulsion of water-in-oil not dissolved in water before its introduction into the mixer. This reverse emulsion can be, preferably, of the standard type or possibly of the microemulsion type, which differs from standard emulsions by smaller particle sizes (of the order of 0.1 micrometer).

The ratio of polymer in reverse emulsion possibly diluted in the oil prior to use can range particularly from 0.2% to 1% by weight/dust, and preferably is between 0.2 and 0.5% by weight. It is advantageous to note that throughout the description and in all claims the ranges of values include the limits. Obviously, the optimum quantity will depend on the nature of the particles and on the properties required.

b/ The Second Binder of the Silicate Type:

The silicates used according to the invention as binders are alkaline metal silicates and are used in liquid form namely at a temperature above their crystallization point.

By the term <<silicates>> are meant salts of silica ($SiO_2$). Among the alkaline silicates that can be used to achieve the object of the invention one can mention those of ammonium, sodium, potassium, lithium and particularly those of sodium and potassium. Preferably used is a sodium silicate, also known as silicate of soda, or soluble glass having the simplified formula: $SiO_2.NaOH$. Advantageously, the silicate used is sodium disilicate having a $SiO_2/Na_2O$ molar ratio between 1.6 and 3.2, and optimally of the order of 2.

In an advantageous embodiment, the silicate represents between 2 and 5% by weight of the agglomerates formed, and the high-molecular-weight polymer represents from 5 to 40% by weight of the silicate.

In a particular embodiment, the second binder can also contain a surface-active agent representing in practice less than 10% by weight of the said second binder, and possibly even the same amount of a wetting agent such as, for example, a compound of the type of oleyl phosphate ethers, polyol esters, polyethylene oxide ethers, polyethoxylated sorbitan esters, sorbitan esters, liquid solutions of lanolinic alcohol, esters of polyethylene glycol, acetylated polyoxyethylenes derived from lanolin, nonyl phenoxy poly(ethyleneoxy)ethyl alcohols, ethers of polyethylene glycol derived from lanolinic alcohol, ethoxylated cholesterol, trimethyl cetyl ammonium bromide, derivatives of diisobutylphenoxyethoxyethyl dimethylbenzylammonium alkyl chloride, etc. . . .

Quite evidently, the following examples are given solely for the purposes of illustrating the object of the invention without in any way constituting a limitation thereof.

EXAMPLES

The dusts used in the following examples are waste products from steel mills and have been prepared as follows:

25% of 'BGL' Greasy Roll mill Sludge

75% of Granular Steel Mill Sludge

This mixture is treated with lime and then introduced into the mixer (capacity: 2 met. tons).

The special characteristic of this briquetting mixture is the hydrophobic nature of the powder due to the presence of hydrocarbons. It is very important to take this characteristic into account from a chemical point of view: the binder will have to show optimum affinity for the powder so as to obtain an intimate mixture in the mixer and maximum adhesive force during the briquetting phase.

The binders are then added and mixed in the following sequence:

The high-molecular-weight polymer is added first in the form of a reverse emulsion by means of a completely manual compressed-air pump. The addition is made by opening the compressed-air valve for a given length of time;

After a certain mixing time, the silicate-type binder is added by means of a volumetric pump fitted with a gravimetric flow meter.

Overall, the time elapsed between the introduction of the binder or binders into the mixer and the outflow of the mixture to the compactor is 5 minutes.

Once the mixture was obtained, it is transferred to the compaction equipment.

The device used for the tests is a drum-type compaction machine. The pressure used is of the order of 100 bars.

For comparison, the binders used are those conventionally used by the industry, namely molasses and lignosulfonate. Their major drawback is that they introduce sulfur into the steel, the result of which is that the steel becomes brittle.

The tests were carried out by varying the dosage and the nature of the polymer. To do this, the five following polymers were used:

| Name of product | Chemical composition (molar ratio) | Dry polymer/oil ratio | Mol. weight of polymer (g/mol) |
|---|---|---|---|
| EM533ce1 (anionic) | Acrylamide/sodium acrylate (70/30) | 1.2 (counter-example) | 10,000,000 |
| EM533ce2 (anionic) | Acrylamide/sodium acrylate (70/30) | 0.1 (counter-example) | 10,000,000 |
| EM533a (anionic) | Acrylamide/sodium acrylate (70/30) | 0.5 | 10,000,000 |
| EM533b (anionic) | Acrylamide/sodium acrylate (70/30) | 0.5 | 15,000,000 |
| EMcat (cationic) | Acrylamide/Adame, chloromethylated (90/10) | 0.5 | 13,000,000 |

Adame: dimethylaminoethyl acrylate

Sequence of Addition:

Once the filling of the mixer is finished, the first (or only) binder is introduced.

then, after 2 minutes of mixing, if necessary the 2$^{nd}$ binder is introduced.

After a total kneading time of 5 minutes, the mixer is immediately emptied to the compactor.

Dosage: carried out by means of volumetric or pneumatic pumps.

Ball appearance test: Visual test; the ball must be well shaped, the shape is that of a rectangular pebble. One looks for a smooth outer appearance and effective interlocking (no multilayer formation).

Waste fines test: After screening the balls at the exit from the compressor, the waste fines are set aside to be weighed. The ratio is: weight of waste fines/total weight of mixture (2 met. tons), expressed in %.

Ball hardness test: With a manual press applying a variable pressure on the ball; the test ends when the ball splits and/or bursts. This test is performed on balls after 2 hours and after 24 hours. The hardness is expressed in kg/ball (weight necessary to break the ball). The higher this number, the better are the balls. Note that 250 kg is the upper limit of the manual test, this test having been perfectly validated for an excellent ball quality.

RESULTS

| Test | Binder 1 (dosage in active component/ balls) | Binder 2 (dosage in active component/ balls) | Ball appearance | Waste fines (%) | Hardness at 2 h | Hardness at 24 h |
|---|---|---|---|---|---|---|
| 1 | | Molasses (4.5%) | Smooth, well shaped | 6.5 | 180 | 200 |
| 2 | | Lignosulfonate (4%) | Smooth, well shaped | 25 | 160 | 200 |
| 3 | | Disilicate (3.5%) | Brittle, poorly shaped | | | |
| 4 | | Disilicate (4%) | Brittle, poorly shaped | | | |
| 5 | | Disilicate (4.5%) | Brittle, poorly shaped | | | |
| 6 | EM533a (0.1%) | Disilicate (3.5%) | Brittle, poorly shaped | | | |
| 7 | EM533a (0.3%) | Disilicate (3.5%) | Smooth, well shaped | 35 | 185 | 210 |
| 8 | EM533a (1%) | Disilicate (3.5%) | Smooth, well shaped | 30 | 190 | 210 |
| 9 | EM533b (0.3%) | Disilicate (3.5%) | Smooth, well shaped | 7 | 200 | 250 |
| 10 | EMcat (0.3%) | Disilicate (3.5%) | Smooth, well shaped | 35 | 180 | 200 |
| 11 | EM533ce1 (0.3%) | Disilicate (3.5%) | Brittle, poorly shaped | | | |
| 12 | EM533ce2 (0.3%) | Disilicate (3.5%) | Brittle, poorly shaped | | | |
| 13 | EM533a (1%) | | Brittle, poorly shaped | | | |

-continued

| Test | Binder 1 (dosage in active component/ balls) | Binder 2 (dosage in active component/ balls) | Ball appearance | Waste fines (%) | Hard-ness at 2 h | Hard-ness at 24 h |
|---|---|---|---|---|---|---|
| 14 | Disilicate (3.5%) | EM533a (0.3%) | Brittle, poorly shaped | | | |
| 15 | EM533b (0.3%) | Bentonite (3.5%) | Not shaped, residual powder | 75 | 69 | 70 |
| 16 | EM533b (0.3%) | Sodium chloride | Not shaped, residual powder | 70 | 73 | 73 |
| 17 | EM533b (0.3%) | Sodium carbonate | Not shaped, residual powder | 77 | 80 | 82 |
| 18 | EM533b (0.3%) | Sodium phosphate | Not shaped, residual powder | 73 | 79 | 79 |

Dosages are given in weight.

The tests performed show the following:

3-5: silicate used by itself does not work;

6-10: the agglomeration process according to the invention gives very good results without either the load (anionic or cationic) or the molecular weight affecting the efficacy of compaction;

13: the polymer in emulsion used by itself is not sufficient for good compaction;

14: the sequence of binder introduction is very important;

15-18: compared to test 9, the carbonates, chloride and phosphate of sodium do not give satisfactory results in the formation of the briquette. The same is true for bentonite.

The invention claimed is:

1. Process for agglomerating industrial dusts comprising:

kneading in a vat the dusts to be agglomerated in the presence of a first binder comprising a polymer with a molecular weight above 500,000 g/mol, as a reverse emulsion, then adding to the vat separately, while still kneading, a second binder comprising a silicate of an alkaline metal, and finally compacting resulting agglomerates under pressure.

2. Process according to claim 1, wherein the polymer is water-soluble and presents an ionicity between 10 and 90 mole % and comprises:

at least one monomer selected from the group consisting of ionic, cationic, zwitterionic and anionic monomers, and at least one nonionic monomer.

3. Process according to claim 2, wherein the polymer further comprises from 0.02 to 2 mole % of a hydrophobic monomer or hydrophobic monomers.

4. Process according to claim 2, wherein the polymer comprises at least one anionic monomer, and at least one nonionic monomer.

5. Process according to claim 1, wherein the polymer is derived from:

a/ at least one ionic monomer selected from the group consisting of: anionic monomers containing a carboxylic function selected from the group consisting of acrylic acid, methacrylic acid, and their salts; and anionic monomers having a sulfonic acid function, selected from the group consisting of 2-acrylamido-2-methylpropanesulfonic acid (ATBS) and the salts thereof, b/ and at least one nonionic monomer selected from the group consisting of acrylamide, methacrylamide, N-vinylpyrrolidone, vinyl acetate, vinyl alcohol, acrylate esters, allyl alcohol, N-vinylacetamide and N-vinylformamide.

6. Process according to claim 5, wherein the polymer is further derived from:

one or more cationic monomers selected from the group consisting of acrylate of dimethylaminoethyl (ADAME) and methacrylate of dimethylaminoethyl (MADAME) quaternized or in the form of a salt, dimethyldiallylammonium chloride (DADMAC), acrylamidopropyltrimethylammonium chloride (APTAC) and methacrylamidopropyltrimethylammonium chloride (MAPTAC).

7. Process according to claim 5, wherein the polymer is further derived from:

a hydrophobic monomer selected from the group consisting of esters of (meth)acrylic acid with an alkyl, arylalkyl and/or ethoxylated chain, derivatives of (meth)acrylamide with an alkyl, arylalkyl or dialkyl chain, cationic allylic derivatives, hydrophobic anionic or cationic (meth)acryloyl derivatives, anionic and cationic monomers derived from (meth)acrylamide bearing a hydrophobic chain.

8. Process according to claim 1, wherein the reverse emulsion is a water in oil emulsion having a dry polymer/oil weight ratio at time of use between 0.15 and 1.

9. Process according to claim 8, wherein the dry polymer/oil weight ratio is between 0.3 and 0.8.

10. Process according to claim 9, wherein said dry polymer/oil ratio is of the order of 0.5.

11. Process according to claim 1, wherein concentration of the polymer as injected into the vat is between 5 and 20% by weight.

12. Process according to claim 1, wherein ratio of polymer in the reverse emulsion/dust is between 0.2% and 1% by weight.

13. Process according to claim 12, wherein said ratio is between 0.2 and 0.5% by weight.

14. Process according to claim 1, wherein the silicate represents from 2 to 5% by weight of the resulting agglomerates and the high-molecular-weight polymer represents from 5 to 40% by weight of the silicate.

15. Process according to claim 1, wherein the alkaline metal silicate is selected from the group consisting of silicates of sodium, potassium and lithium.

16. Process according to claim 1, wherein the silicate is sodium disilicate presenting an $SiO_2/Na_2O$ molar ratio between 1.6 and 3.2.

* * * * *